United States Patent [19]

Ackerson

[11] 4,149,341

[45] Apr. 17, 1979

[54] SECURITY GATE

[76] Inventor: Gaylord Ackerson, 565 Cleveland, Bushnell, Ill. 61422

[21] Appl. No.: 881,047

[22] Filed: Feb. 24, 1978

[51] Int. Cl.[2] ..... E01F 13/00

[52] U.S. Cl. ..... 49/49; 49/34

[58] Field of Search ..... 49/49, 33, 131, 44, 49/149, 34, 58; 160/331, 332; 256/3

[56] References Cited

U.S. PATENT DOCUMENTS

| | | | |
|---|---|---|---|
| 2,543,893 | 3/1951 | Chandler | 49/49 X |
| 2,693,050 | 11/1954 | Neid | 49/49 X |
| 3,803,763 | 4/1974 | Reed et al. | 49/49 |
| 3,938,638 | 2/1976 | Moule | 49/49 X |

*Primary Examiner*—Kenneth Downey

*Attorney, Agent, or Firm*—Hume, Clement, Brinks, William & Olds, Ltd.

[57] ABSTRACT

A one-way security gate is disclosed which includes a plurality of rotatable rods which are suspended from a horizontally mounted shaft. These rods hang vertically and are free to rotate about the shaft in a limited arc. This limited arc is oriented so that the individual rods can be rotated upward on one side of the shaft only. Accordingly, the rods rotate to allow objects to pass under the shaft in one direction only. In the preferred embodiment of this gate each rod is mounted both to rotate about the shaft and to hinge in a direction transverse to the plane of rotation. These hinges allow the rods to be pushed out of the vertical plane and thereby prevent trapezoidally-shaped objects such as grocery carts from wedging between a pair of rods.

6 Claims, 4 Drawing Figures

FIG. 1
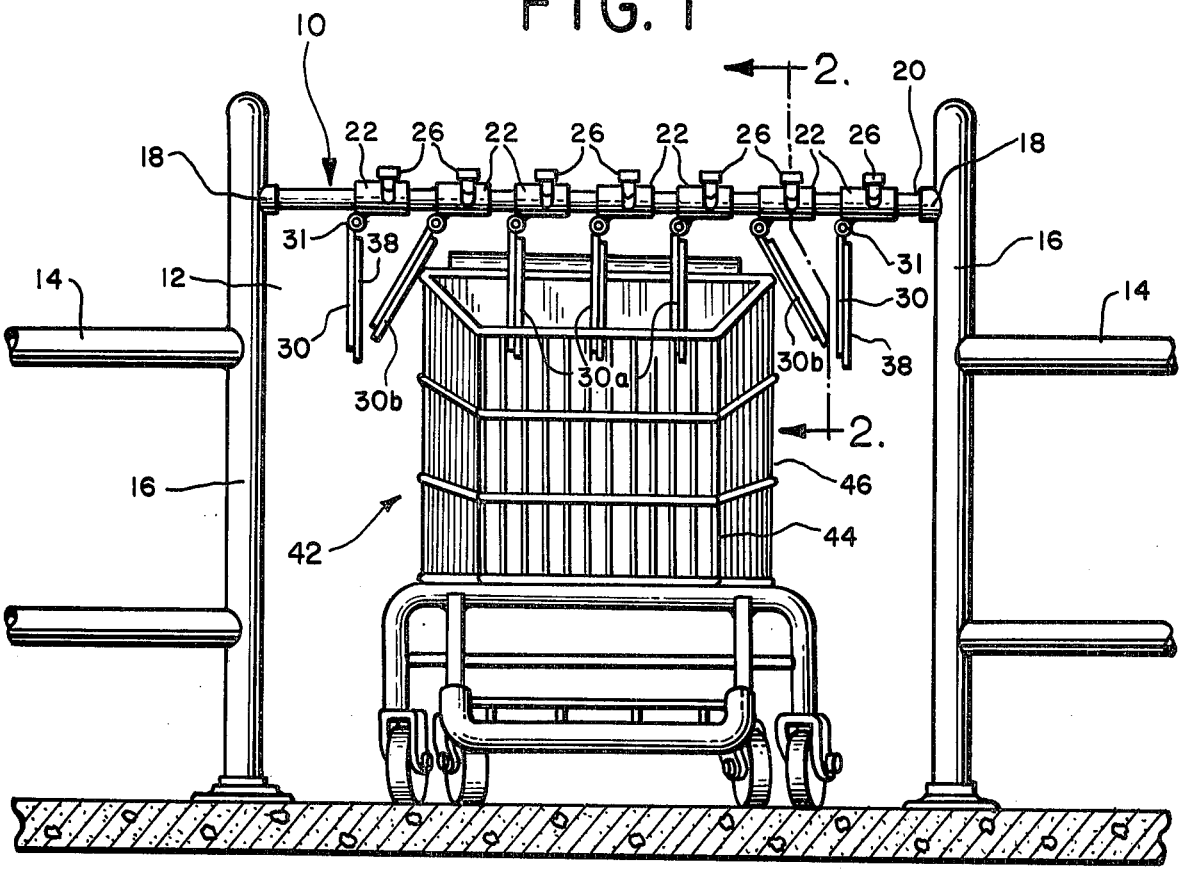
FIG. 2
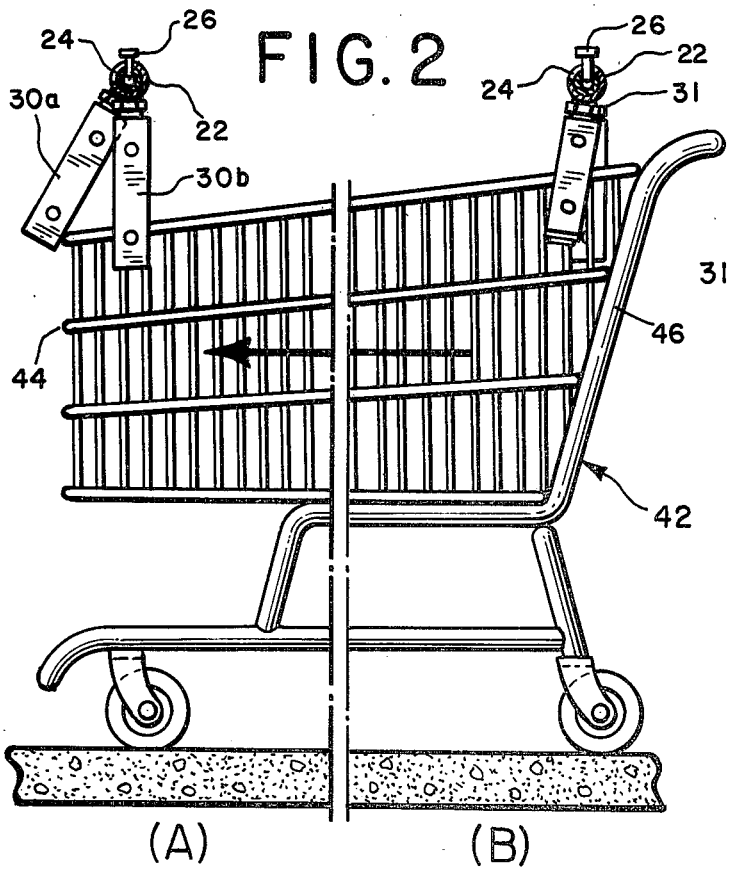
FIG. 3
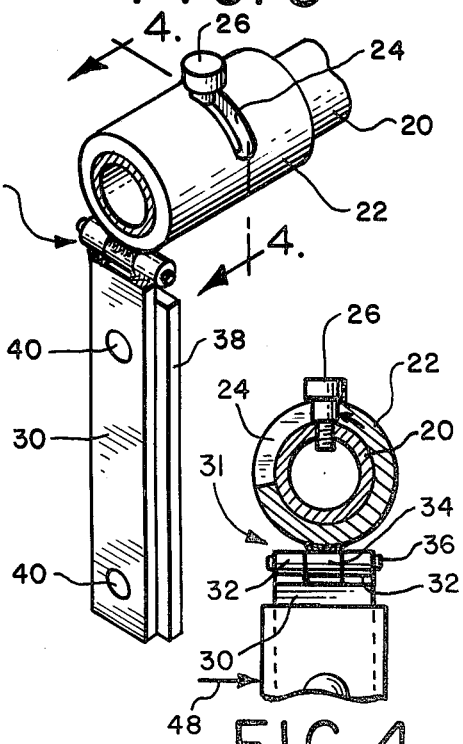
FIG. 4

SECURITY GATE

BACKGROUND OF THE INVENTION

The present invention is directed to a one-way security gate of the type which permits objects to be passed through the gate in a forward direction while obstructing passage in the reverse direction, and more particularly to a one-way security gate which is suitable for use with grocery carts.

Modern grocery stores are typically designed to encourage self service by the customer, who is usually provided with a grocery cart for use within the store. These carts are used by customers to transport items from the shelf area of the store up to a cashier, who totals the purchases and collects payment. One of the recurring problems in such grocery stores concerns the flow of grocery carts. These carts must be returned to the shelf area for reuse by other customers after they have been brought to the cashier. However, the route used to return the carts must be blocked in some way so as substantially to prevent customers from removing loaded carts from the shelf area without passing past a cashier. The means used to block the return route should preferably be inexpensive to construct, easy to install, and should operate automatically and reliably.

SUMMARY OF THE INVENTION

The present invention is directed to a one-way security gate which includes a plurality of rods which are rotatably mounted on a shaft. These rods are normally positioned so as substantially to obstruct the gateway, and are mounted on the shaft in such a way that an object passsing through the gateway in the forward direction can rotate the rods in the forward direction, thereby removing the obstruction. However, the rods are prevented from rotating out of the gateway in the reverse direction, and, therefore, an object is obstructed from passing through the gateway in the reverse direction. In the preferred embodiment at least one of the rods of the gate is movable in the direction transverse to the direction of rotation in order to reduce wedging of trapezoidally-shaped objects such as grocery carts in the gate.

The gate of this invention is well suited for installation as a security gate in a grocery store. When so installed it permits grocery carts to be easily returned to the shelf area of the store. It opens automatically to allow a cart to pass through the gateway in the forward direction without wedging or jamming. Furthermore, the gate substantially obstructs the passage of carts through the gateway in the reverse direction. In the preferred embodiment the rotatable rods are spaced so that several rods would have to be simultaneously lifted out of the gateway in order to allow a cart to pass through the gateway in the reverse direction.

The gate of this invention is easy to install, automatic in operation, and inexpensive to fabricate. The invention itself, together with further objects and attendant advantages thereof, will be best understood by reference to the following description taken in connection with the accompanying drawings.

BRIEF DESCRIPTION OF THE DRAWINGS

FIG. 1 is an elevation view of the preferred embodiment of the one-way gate of the invention showing a grocery cart passing through the gate.

FIG. 2*a* is an elevation view taken along line 2—2 of FIG. 1 showing the movement of the gate as a grocery cart initially contacts the gate.

FIG. 2*b* is an elevation view taken along line 2—2 of FIG. 1 showing the position of the gate with a grocery cart almost through the gate.

FIG. 3 is a detailed perspective view of a portion of the gate depicted in FIG. 1.

FIG. 4 is a sectional view taken along line 4—4 of FIG. 3.

DETAILED DESCRIPTION OF THE PREFERRED EMBODIMENT

Referring now to the drawings, FIG. 1 depicts the preferred embodiment of the gate 10 of this invention which is mounted over the gateway 12 between two sections of fence 14. Each section of fence 14 terminates in an upright post 16 and each post 16 is provided with a sleeve 18. The principal structural element of the gate 10 is the horizontally mounted shaft 20 which is inserted in the sleeves 18 on the posts 16. A plurality of collars 22 are rotatably mounted on the shaft 20. As best seen in FIG. 3, each collar 22 defines an elongated notch 24 which extends around a portion of the circumference of the collar 22. Each collar 22 is positioned along the length of the shaft 20 by a bolt 26 which extends through the notch 24 and is secured to the shaft 20. The rotation of the collar 22 about the shaft 20 is restricted to a limited arc determined by the orientation of the notch 24.

A rod 30 is mounted on each collar 22 by means of a hinge 31, and each rod is, therefore, free to rotate about the hinge laterally, transverse to the direction of rotation of the collar 22 about the shaft 20. The hinge 31 includes a central tubular section 34 which is welded to the collar 22, two lateral tubular sections 32 which are secured to the rod 30, and a pin 36 which passes through the tubular sections 32, 34, thereby securing them together. In the preferred embodiment shown, each hinge 31 is a two-way hinge which permits each rod 30 to rotate laterally about the hinge in either direction. Thus, the rod 30 can be pushed to either side of the vertical as necessary to avoid wedging. A plate 38 is mounted to each rod 30 by fasteners 40 in order to increase the thickness and, therefore, the visibility of the suspended rods.

This embodiment of the invention is adapted for use with carts such as the grocery cart 42 shown in FIG. 1. This cart 42 is trapezoidally shaped, and includes a front section 44 which is narrower than the rear section 46. As best shown in FIGS. 1, 2*a* and 2*b* the rods **30*a* in front of the cart 42 are rotated upward as the cart 42 passes under the shaft 20 in the forward direction, thereby allowing the cart 42 to pass through the gateway 12. The rods 30*b* which are not contacted by the front section 44 remain hanging vertically. These rods 30*b* move laterally about the hinges 31 when they come in contact with the rear section 46 of the cart 42. In this way the cart is prevented from wedging against a pair of rods 30*b* which were not deflected by the front section 44. After the cart has passed through the gateway 12 the force of gravity returns the rods 30** to the vertical position.

The notch 24 on each collar 22 is oriented so that the rods 30 can be rotated from the vertical position in only one direction, the forward direction. Thus, when a cart is pushed into the gate 10 in the reverse direction, forces are applied to the rods 30 in the direction indicated by the arrow 48 in FIG. 4. These forces tend to rotate the collar 22 about the shaft 20; however, such rotation in the reverse direction is prevented by the bolt 26 which contacts one end of the elongated notch 24.

The dimensions and construction materials used in the gate of this invention may be chosen for a particular application according to well known principles of mechanical and production engineering; however, in one exemplary embodiment which has been advantageously used in several applications, the shaft 20 is formed from a section of one-inch iron pipe. The collars 22 are formed from sections of one and one-half inch iron pipe, and the rods 30 are formed from strips of flat steel approximately three-sixteenths of an inch thick and nine inches long. In this embodiment, the plates 38 are formed from one-half inch thick plexiglass and adjacent rods 30 are spaced approximately six inches apart.

Of course, it should be understood that various changes and modifications to the preferred embodiment described herein will be apparent to those skilled in the art. For example, biasing means may be provided to return the rods 30 to the central positions, and details of construction, proportions, or materials may be altered. Such changes and modifications can be made without departing from the scope of the present invention and without diminishing its attendant advantages. It is, therefore, intended that such changes and modifications be covered by the following claims.

I claim:

1. A one way security gate adapted to permit movement of an object in a forward direction through a gateway while obstructing movement of the object in the reverse direction through the gateway comprising:

a shaft mounted adjacent the gateway;

a plurality of rods rotatably mounted on the shaft;

means for rotationally positioning the rods on the shaft so as substantially to obstruct movement of the object through the gateway, said positioning means operating to prevent the object from rotating the rods in the reverse direction when the object approaches the gateway in the reverse direction, while operating to permit the object to rotate the rods in the forward direction when the object passes through the gateway in the forward direction; and means for allowing at least a portion of the rods to move in a direction transverse to the direction of rotation, thereby reducing the tendency of the object passing through the gateway to wedge between two of the rods.

2. The gate of claim 1 wherein the means for rotationally positioning the rods on the shaft includes a collar which is rotatably mounted on the shaft and is secured to a rod, and the collar is provided with an elongated notch extending around a portion of the circumference of the collar, and a pin is provided which is secured to the shaft and extends through the notch.

3. A one way security gate adapted to permit a grocery cart to pass through the gate in a forward direction while substantially obstructing the grocery cart from passing through the gate in the reverse direction, comprising:

a shaft mounted substantially in the horizontal direction at a height greater than that of the cart;

a plurality of collars rotatably mounted on the shaft, each of said collars defining an elongated notch extending around a portion of the circumference of the collar;

a plurality of pins secured to the shaft, each of said pins extending through the elongated notch of one of the collars, said pins cooperating with said notches to restrict the rotational travel of said collars;

a plurality of rods, each of said rods secured to one of the collars at a predetermined place relative to the elongated notches whereby said rods are free to rotate upward from the vertical in the forward direction but are substantially prevented by said pins and said notches from rotating upward from the vertical in the reverse direction.

4. The gate of claim 3 wherein a plurality of hinges is provided, each of said hinges serving to secure one of the rods to one of the collars, said hinges oriented to permit the rods to move transverse to the plane of rotation about the shaft.

5. A one way security gate adapted to permit a grocery cart to pass through the gate in a forward direction while substantially obstructing the grocery cart from passing through the gate in the reverse direction comprising:

a shaft mounted substantially in the horizontal direction at a height above that of the cart;

a plurality of rods suspended from the shaft so as to be rotatable about the shaft in a limited arc, said limited arc oriented to permit the rods to be pushed upward from the vertical by the cart when passing under the shaft in the forward direction and substantially to prevent the rods from being pushed upward by the cart when passing under the shaft in the reverse direction; and a hinge attached to one of the plurality of rods which is oriented to permit at least a portion of the rod to move in a direction transverse to the direction of rotation, and thereby to reduce the tendancy of the grocery cart to wedge between two of the plurality of rods as the cart passes through the gate in the forward direction.

6. The gate of claim 5 wherein each of said plurality of rods is affixed to a collar which is rotatably mounted on the shaft, and each collar is provided with an elongated notch extending around a portion of the perimeter of the collar, and a plurality of pins is provided, one of which is secured to the shaft and extends through the notch of each of the collars.

* * * * *